US008413350B2

(12) United States Patent
Scozzafava

(10) Patent No.: US 8,413,350 B2
(45) Date of Patent: Apr. 9, 2013

(54) INTERCHANGEABLE SHOE WITH CLIPS AND LOOPS

(75) Inventor: Frank Charles Scozzafava, New York, NY (US)

(73) Assignee: Mix Bikini Inc., Clermont, FL (US)

( * ) Notice: Subject to any disclaimer, the term of this patent is extended or adjusted under 35 U.S.C. 154(b) by 483 days.

(21) Appl. No.: 12/534,326

(22) Filed: Aug. 3, 2009

(65) Prior Publication Data

US 2009/0293312 A1 Dec. 3, 2009

Related U.S. Application Data

(63) Continuation-in-part of application No. 11/307,460, filed on Feb. 8, 2006, now abandoned.

(51) Int. Cl.
*A43B 3/24* (2006.01)
*A43B 3/12* (2006.01)

(52) U.S. Cl.
USPC ..... 36/101; 36/11.5

(58) Field of Classification Search ..... 36/101, 36/11.5, 100, 15
See application file for complete search history.

(56) References Cited

U.S. PATENT DOCUMENTS

| | | | | |
|---|---|---|---|---|
| 2,095,340 | A * | 10/1937 | Meyer | 24/198 |
| 2,140,164 | A * | 12/1938 | Moffatt | 24/199 |
| 2,527,844 | A * | 10/1950 | Owen | 2/268 |
| 2,976,623 | A | 6/1958 | Gallaway | |
| 3,925,915 | A | 12/1975 | Colli | |
| 4,450,633 | A | 5/1984 | Connelly | |
| 4,461,102 | A * | 7/1984 | DeVincentis | 36/101 |
| 5,992,058 | A | 11/1999 | Jneid | |
| 7,168,189 | B2 | 1/2007 | Phelan | |
| 7,174,657 | B2 | 2/2007 | Berg et al. | |
| 7,200,959 | B2 | 4/2007 | Spann | |
| 7,272,899 | B1 | 9/2007 | Marak | |
| 2006/0174514 | A1 | 8/2006 | Scozzafava et al. | |

* cited by examiner

*Primary Examiner* — Ted Kavanaugh
(74) *Attorney, Agent, or Firm* — Hoffmann & Baron, LLP; Betsy Kingsbury Dowd

(57) ABSTRACT

An article of footwear comprising a shoe base constructed and adapted for receiving a foot having a toe section and an ankle section with at least two loops fixedly attached to the toe section. A toe strap having two ends for securing the shoe base to the foot is removably attached to the loops proximate the toe section by a hoop like clip at each end of the toe strap. Each hoop like clip has an internal surface and two terminal ends defining a gap in the hoop and at least one spur on the internal surface of the hoop like clip proximate the gap.

13 Claims, 3 Drawing Sheets

INTERCHANGEABLE SHOE WITH CLIPS AND LOOPS

This application is a continuation-in-part of patent application Ser. No. 11/307,460 filed on Feb. 8, 2006, now abandoned titled: Interchangeable Shoe with Clips and Loops.

BACKGROUND OF THE INVENTION

This invention pertains to footwear, and more specifically, pertains to women's shoes. For the most part, shoes comprise of a base for supporting the foot and uppers for securing the foot to the base. Many styles of footwear, constructed of various components, have long existed. The uppers play a large role as to the appearance and function of the shoe. The uppers may be of a variety of colors and materials, such as fabric, leather or a synthetic material.

Certain shoes have been manufactured with removable uppers for varying the appearance of the shoe. U.S. Pat. No. 5,992,058 (Jneid) and U.S. Pat. No. 3,925,915 (Colli) use a detachable shoe strap system where snap fasteners are affixed to the shoe base with the uppers having a snap fasteners. The disadvantages of both Jneid and Colli range from aesthetics, as the snap fasteners are visible; and function, as the protruding snaps can catch on external objects causing the shoe to come apart and risk possible injury to the foot.

Both problems may be solved with a shoe whose fastener is both aesthetically pleasing and well as flush and strong to protect the foot in the base of the shoe.

SUMMARY OF THE INVENTION

It is the object of the invention to provide a shoe having interchangeable components comprising a shoe base, detachable clips, and interchangeable straps for attaching straps/uppers.

It is another object of the invention to provide a shoe having interchangeable components comprising a shoe base, detachable clips, and interchangeable straps for attaching straps/uppers having an integrated loop used to attach the clips.

Still another object of the invention is to provide a shoe having interchangeable components comprising a shoe base, detachable clips, and interchangeable straps for attaching straps/uppers wherein the detachable clips possess a spur to prevent the interchangeable strap from becoming detached from the shoe base while the shoe is being worn.

The objects of the invention are achieved by provision of an interchangeable shoe with a three part clip and loop design, with the ability to interchange the straps from the main base of the shoe. This is achieved by outfitting the base with an integrated loop, where a specially designed clip would then attach. All straps are made with integrated loops at the ends. The loops are then attached to the clip by sliding each end through the integral opening in the clip creating a finished product. Spurs located on the inner surface of the integral opening in the clip prevents detachment of the shoe components while the shoe is being worn.

DESCRIPTION OF THE DRAWINGS

The present invention and the manner in which it may be practiced is further illustrated with reference to the accompanying drawings wherein.

DETAILED DESCRIPTION OF THE INVENTION

Figure 1:
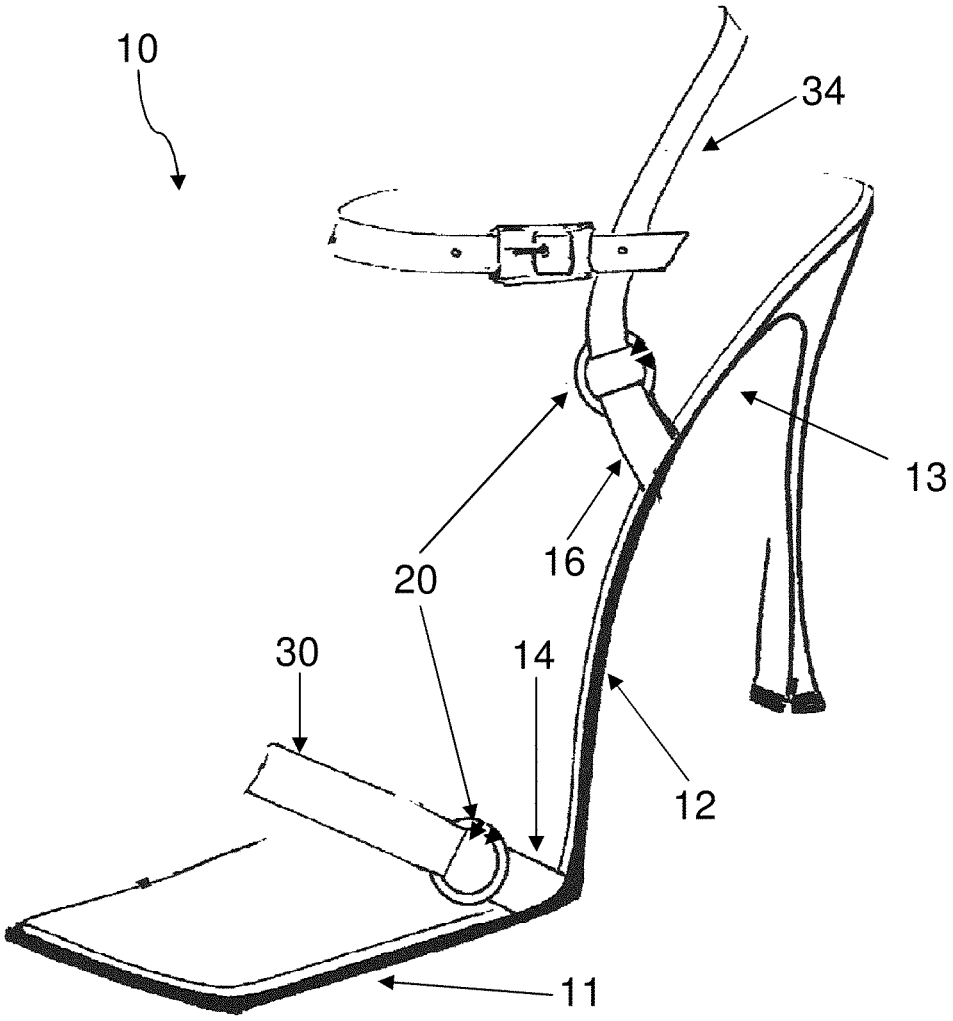
FIG. 1 is a perspective view of one embodiment of the present invention.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. § 112.

Figure 2:
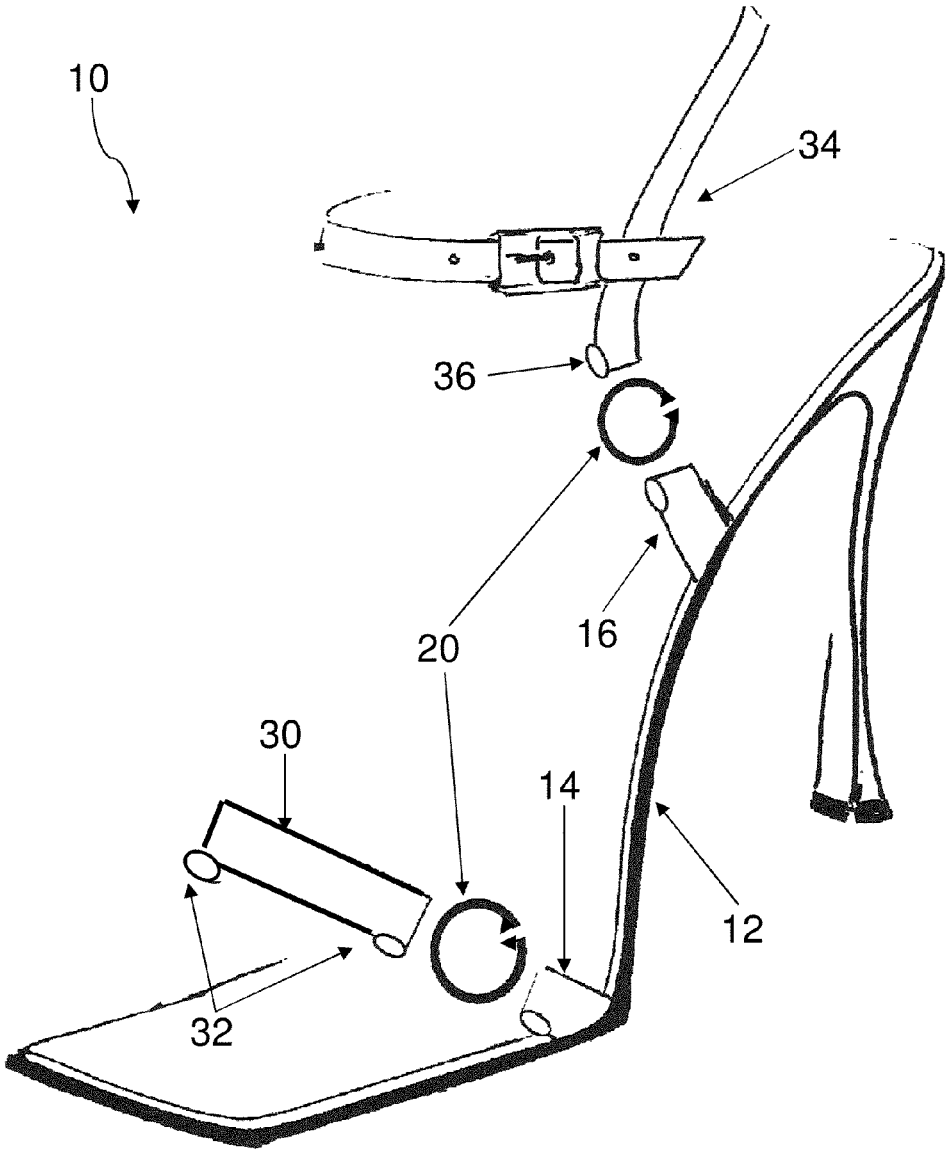
FIG. 2 is an exploded view of one embodiment of the present invention.

Adverting now to the drawings, with reference to FIGS. 1 and 2, a preferred embodiment of the present invention is indicated generally by numeral 10. Footwear article 10 is made up generally of shoe base 12 having a toe section 11 and ankle section 13; integrated loops 14 proximate the toe section 11 and integrated loops 16 proximate the ankle section 13; foot strap 30 having loop ends 32, where one loop end 32 is removably attached to toe section loop 14 by a first clip 20; and ankle strap 34 having loop end 36 which is removably attached to ankle section loop 16 by a second clip 20. Although only the left side of shoe base 12 is shown in FIGS. 1 and 2, the right side of shoe base 12 is constructed in an identical manner as described above. Specifically, the interchangeable shoe is constructed through a three-piece system, as opposed to only a two-piece system. In a preferred embodiment, interchangeable clips 20 are connected to the shoe base by slipping one clip onto each of the loops 14 and 16. These clips can be selected, for instance, to coordinate with the wearer's wardrobe and can be made out of any suitable material, including but not limited to metal, plastic, ceramic, glass, etc. Interchangeable strap 30 is removably attached to the clips on the toe section of the shoe base, while interchangeable strap 34 is removably attached to the clips at the ankle position of the shoe base. Again, straps 30 and 34 are aesthetically selected to coordinate with the wearer's wardrobe and can be constructed of any suitable material, including but not limited to cloth fabric, leather, plastic, etc. Conversely, clips 20 are removably attached to the straps and removably attached to the shoe base loops.

Figure 3:
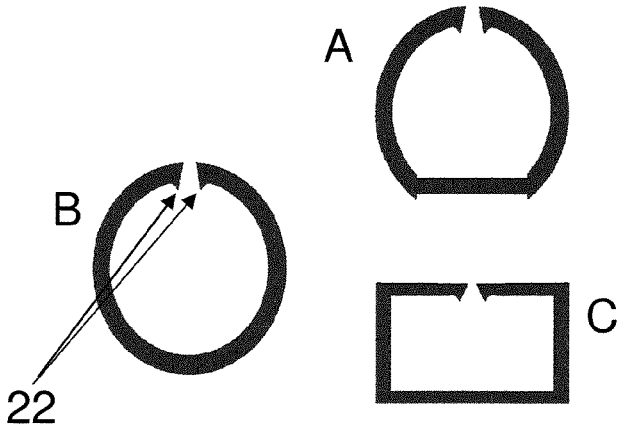
FIG. 3 is an illustrative example of the clips which can be used in one embodiment of the present invention.

FIG. 3 is a representative example of the types of open ended clips 20, which can be used in one embodiment of the present invention. As shown, clips 20 A-C are hooplike members that have two terminal ends defining a gap. It should be readily obvious to those of ordinary skill in the art that Clips 20 are constructed in a variety of shapes such as circular, rectangular, or roughly D-shaped. It should be noted that these examples are merely illustrative and are not exhaustive of the shapes that can be used. It must be understood that the shape of Clips 20 could be made in any other the shape consistent with a hoop like clip having an internal surface and two terminal ends defining a gap in the clip. Clips 20 further comprise a spur 22 on the internal surface proximate at least one terminal end defining the clip gap. These spurs prevent the straps from slipping free of the clips while the shoe is being worn.

Figure 4A:
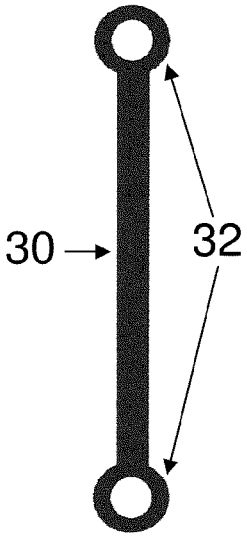
FIG. 4*a* is an illustrative example of a strap which can be used in one embodiment of the present invention.
Figure 4B:
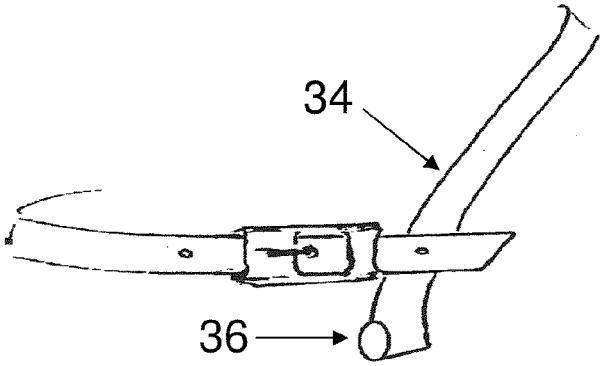
FIG. 4*b* is a perspective view of an illustrative example of an ankle strap which can be used in one embodiment of the present invention.

Examples of straps envisioned by one embodiment of the present invention are shown in FIGS. 4*a* and 4*b*. FIG. 4*a* shows a possible foot strap comprising strap 30 and loop ends 32 which are inserted into clips 20 (not shown). FIG. 4*b* is illustrative of an ankle strap comprising strap 34 which can be adjustable to fit snugly around the wearer's ankle and loop ends 36 which are inserted into clips 20 (not shown).

Figures 5A, 5B:
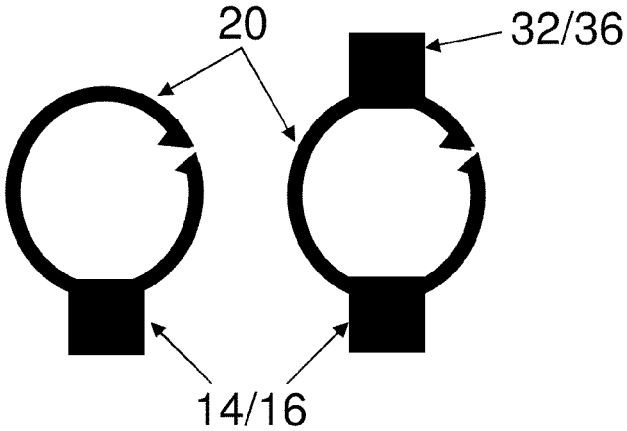
FIG. 5*a* is an illustrative use of the clips in one embodiment of the present invention showing a shoe base hoop inserted into the clip.
FIG. 5*b* is an illustrative use of the clips in one embodiment of the present invention showing both the shoe base hoop and strap inserted into the clip.

FIGS. 5*a* and 5*b* demonstrate the clip operation in one embodiment of the current invention. The roughly oval depiction of the clips in FIGS. 5*a* and 5*b* are merely illustrative and by no means limit the various configurations possible for clip 20. As shown in FIG. 5*a,* clip 20 comprises a partially closed hoop with a small opening for passage of the shoe's hoop and the strap's loop into the clip enclosure. For illustrative purposes, FIG. 5*a* shows clip 20 with shoe base hoop 14 or 16 passed through the clip opening. FIG. 5*b* shows both shoe base 14 or 16 and strap loop 32 or 36 within clip 20. Importantly, it should be noted that this system comprises three distinct entities, namely shoe base hoop 14 or 16, strap 30 or 34, and clip 20. Being a three-part system and having both strap 30 or 34 and clip 20 as interchangeable components, the present invention is distinguishable from any other convertible shoe.

An additional embodiment of the present invention comprises a shoe base having a strap removably attached only at the toe section using a pair of hoop like clips. This particular embodiment is suitable for creating a shoe generally known as a flip-flop or a sandal. This embodiment is comprised of a shoe base having a strap removably attached only at the toe section using a pair of hoop like clips. The single strap is sufficient to hold the shoe onto the foot while the shoe is being worn. A wearer can construct a shoe by using a shoe base as shown in the drawings and described above wherein the shoe base has loops at both the toe section and heel section wherein the shoe is constructed with clips and straps with only the toe section integrated loops. An additional embodiment of the present invention comprises a shoe base which possesses loops, clips and straps only at the toe section and nothing at the heel section.

Although the invention has been described with reference to certain preferred embodiments, it will be appreciated by those skilled in the art that modifications and variations may be made without departing from the spirit and scope of the invention. It should be understood that applicant does not intend to be limited to the particular details described above and illustrated in the accompanying drawings.

What is claimed is:

1. An article of footwear comprising:

a shoe base constructed and adapted for receiving a foot having a toe section and an ankle section;

at least two loops fixedly attached to said toe section; and a toe strap having an integrated loop at each end for securing said shoe base to said foot, the toe strap removably attached to said at least two loops fixedly attached to said toe section by a hooplike clip removeably inserted through each integrated loop of said toe strap, wherein each of said toe strap and said clip is independently removeably interchangeable; and wherein each said hooplike clip has an internal surface and two terminal ends defining a gap therebetween in said hoop and a spur on said internal surface of said hooplike clip proximate each terminal end, wherein said hooplike clip is adapted for assembling said integrated loop of said toe strap to one of said at least two loops, said integrated loop of said toe strap and said one of said at least two loops being removably insertable into said gap for assembling.

2. The footwear of claim 1, wherein said hooplike clip is generally triangular in shape.

3. The footwear of claim 1, wherein said hooplike clip is generally rectangular in shape.

4. The footwear of claim 1, wherein said hooplike clip is generally circular in shape.

5. The footwear of claim 1, wherein said hooplike clip is generally D-shaped.

6. The footwear of claim 1, wherein said hooplike clip is polygonal in shape.

7. An article of footwear comprising:

a shoe base constructed and adapted for receiving a foot having a toe section and an ankle section;

at least two loops fixedly attached to said toe section;

at least two loops fixedly attached to said ankle section;

a toe strap having an integrated loop at each end for securing said shoe base to said foot, the toe strap removably attached to said at least two loops fixedly attached to said toe section by a hooplike clip removeably inserted through each integrated loop of said toe strap;

an ankle strap having an integrated loop at each end for securing said shoe base to said foot, the ankle strap removably attached to said at least two loops fixedly attached to said ankle section by a hooplike clip removeably inserted through each integrated loop of said ankle strap, wherein each of said toe strap, ankle strap, and said hooplike clip is independently removeably interchangeable;

wherein each said hooplike clip has an internal surface and two terminal ends defining a gap therebetween in said hoop and at least one spur on said internal surface of said hooplike clip proximate each terminal end, wherein said hooplike clip is adapted for assembling one end of said ankle strap to one of said loops, said one end of said ankle strap and said one of said loops being removably insertable into said gap for assembling.

8. The footwear of claim 7, wherein said hooplike clip is generally triangular in shape.

9. The footwear of claim 7, wherein said hooplike clip is generally rectangular in shape.

10. The footwear of claim 7, wherein said hooplike clip is generally circular in shape.

11. The footwear of claim 7, wherein said hooplike clip is generally D-shaped.

12. The footwear of claim 7, wherein said hooplike clip is polygonal in shape.

13. The footwear of claim 7, wherein each said hooplike clip has an internal surface and two terminal ends defining a gap in said hoop and at least one spur on said internal surface of said hooplike clip proximate each of said gap.

* * * * *